US005412835A

United States Patent [19]

Vosbikian et al.

[11] Patent Number: 5,412,835

[45] Date of Patent: May 9, 1995

[54] LOCKING HINGED DUST PAN

[75] Inventors: Peter S. Vosbikian, Moorestown, N.J.; Haig Vartanian, Cheltenham; Brian A. Gorman, Albrightsville, both of Pa.

[73] Assignee: Quickie Manufacturing Corporation, Cinnaminson, N.J.

[21] Appl. No.: 150,607

[22] Filed: Nov. 10, 1993

Related U.S. Application Data

[63] Continuation-in-part of Ser. No. 21,201, Feb. 23, 1993, Pat. No. 5,367,737.

[51] Int. Cl.[6] ..... A47L 13/52

[52] U.S. Cl. ..... 15/257.7; 15/144.1; 15/257.2; 294/53.5

[58] Field of Search ..... 15/144.1, 257.1, 257.2, 15/257.7; 294/1.4, 53.5, 55

[56] References Cited

U.S. PATENT DOCUMENTS

| | | | |
|---|---|---|---|
| 529,562 | 11/1894 | Mortenson | 294/53.5 |
| 601,678 | 4/1898 | Richter | 15/257.1 |
| 1,810,026 | 6/1931 | Moller | 294/53.5 |
| 3,456,663 | 7/1969 | Blum | 294/1.4 |
| 4,584,735 | 4/1986 | Garber | 15/257.7 |
| 5,285,855 | 2/1994 | Bojar | 294/53.5 |

FOREIGN PATENT DOCUMENTS

| | | | |
|---|---|---|---|
| 0156527 | 10/1985 | European Pat. Off. | 15/257.1 |
| 0382658 | 8/1990 | European Pat. Off. | 15/257.7 |
| 542248 | 1/1932 | Germany | 15/144.1 |

*Primary Examiner*—David A. Scherbel
*Assistant Examiner*—Randall E. Chin
*Attorney, Agent, or Firm*—Eckert Seamans Cherin & Mellot

[57] ABSTRACT

A dust pan assembly has a handle receiving bracket formed or attached at the rear of a dust pan scoop, pivotally receiving an elongated hollow handle. The handle can pivot between and lock at least at two angular positions of the handle and scoop, e.g., in line or perpendicular, via a projecting movable locking pin that engages between the handle and the bracket, in a selected aperture of the bracket. A manual actuator mechanism disengages the lock to allow pivoting of the handle, and has an actuator button projecting through the wall of the handle at an accessible position on the handle out of interference with the dust pan scoop. The locking pin and the actuator button can be simple lateral projections on a V-shaped spring in the handle, the actuator button preferably projecting longer than the locking pin to ensure disengagement and to positively position the locking pin relative to the bracket apertures. In one embodiment the pivot axis of the assembly is also defined by projections of the V-shaped spring.

8 Claims, 9 Drawing Sheets

LOCKING HINGED DUST PAN

CROSS-REFERENCE TO RELATED APPLICATION

This is a continuation-in-part of application Ser. No. 08/021,201, filed Feb. 23, 1993, now U.S. Pat. No. 5,367,737.

BACKGROUND OF THE INVENTION

1. Field of the Invention

The invention relates to a dust pan for manual collection of debris, having a handle attached to a scoop into which debris can be swept for disposal. In particular the invention concerns a dust pan having a bracket attached to the rear of the pan for pivotally receiving an elongated dust pan handle.

The handle is movable between at least two positions where it detachably locks. In a first lock position the pan is substantially perpendicular to the handle for an upright user to sweep debris conveniently into the pan while holding the handle in one hand and a broom in the other. In a second lock position the dust pan is held substantially parallel to the handle, enabling a shovel-like use of the assembly for lifting debris into a disposal container. The arrangement can include a broom receptacle having a clip for a broom handle and a channel in the pan adjacent the dust pan handle for unitary storage of the dust pan assembly and broom. A preferred embodiment includes a locking activator on the handle, arranged to be clear of interference with the pan, for controlling locking of the pan in the respective lock positions.

2. Prior Art

Dust pans are useful for cleaning in and about the home and commercial and industrial buildings. Dust pans typically have a broad shallow container or scoop attached to a handle, the scoop or container being open on one edge. The scoop is rested on the ground and a broom or other implement is used to push dust or other debris over the edge and into the scoop. The scoop is then manipulated to lift and dump the debris into a receptacle.

Conventional home dust pans characteristically have a short handle which is rigidly mounted and protrudes from the rear Of the dust pan scoop substantially in the same plane as the scoop. The user must bend over to grasp the handle and/or must incline the dust pan at an angle to the floor, in order to place the edge of the scoop on the floor to gather dust.

A more "industrial" form of dust pan has an elongated handle that protrudes upwardly when the edge of the scoop is placed on the floor, such that the user positions the scoop with one hand, in opposition to a broom being manipulated with the other hand. Typically, the handle is rigidly mounted perpendicular to the plane of the dust pan scoop and the scoop is open across its top. It is also possible for the scoop to define a container having an open front at the edge of the scoop and a rear portion that is closed over the top of the scoop. The closed-rear form of scoop may swing freely on the handle on a pivot axis near the front of the scoop, such that the rear of the container drops downwardly when the scoop is lifted, capturing the debris.

Whether or not the scoop is attached rigidly, the user of a dust pan with a handle perpendicular to the plane of the scoop does not have to bend over the dust pan to gather debris, and can proceed quickly from place to place to sweep up. However, there are shortcomings in known dust pans having elongated upwardly extending handles.

Where the handle is mounted rigidly perpendicular to the plane of the scoop, it is difficult and awkward for a user to dump the scoop to empty the debris into a receptacle. The user must lift the dust pan, e.g., in a forward arch, over the edge of a container such as a trash receptacle, and then rotate the handle 180° along or perpendicular to the handle axis to dump the debris gathered in the scoop. This motion is awkward and often causes gathered debris to spill out of the dust pan prior to disposal.

Dumping the scoop is also inconvenient when the scoop swings freely on the handle. The user must lift the scoop over the edge of the receptacle, which causes the scoop to rotate such that its open end is up. The user must rotate the scoop manually relative to the handle in a two-hand operation to dump the contents into the receptacle. Thus the user must put down the broom, often dropping the broom and requiring the user to bend over anyway.

Another problem is the difficulty in the display and merchandising of dust pans having upwardly extending handles, and in their compact storage. The pan portion of a rigidly attached arrangement necessarily extends laterally outward from the handle, taking up space in displays and in storage closets. When the dust pan assembly is hung, for example, on a vertical display wall in a store, the pan eliminates viewing space. The dust pan is difficult to remove from a storage closet if other stored items inadvertently are rested on the pan.

The pan portion of a swinging arrangement is more compact if the device is hung by its handle (i.e., the container pivots down). However, this form of device will not stand upright without support, and falling over of the handle is a problem. The swinging nature of the device makes it unsuitable for the general object of using a dust pan as a form of shovel. Finally, the closed nature of the receptacle and the position of the pivot axis well forward of the rear of the scoop both limit the size of debris that can be collected.

It would be desirable to provide a dust pan arrangement, wherein the handle and dust pan scoop are pivotable, but also are arranged to lock selectively at particular positions which are most helpful for the user. The present invention is selectively arranged and locked at either of at least two locked positions. In one position the handle is perpendicular to the dust pan scoop, for sweeping up debris while standing upright. In another position the handle is parallel to the plane of the scoop, for shovel-like operation during pickup or dumping. The scoop preferably extends away from the handle in the parallel position, minimizing the space occupied in storage or display. A channel including clamping means on the dust pan handle and/or the dust pan accommodates the handle of a broom. The broom head rests in the scoop, providing an integral unit for storage, display and transport.

SUMMARY OF THE INVENTION

It is an object of the invention to provide a dust pan assembly with a selectively locked hinge joint between a dust pan handle and scoop, whereby the dust pan is configured for alternative situations.

It is another object of the invention to provide a pivoting dust pan scoop and handle, that pivots substantially 90° around a pivot axis adjacent a rear of the scoop.

It is another object of the invention to provide a pivoting dust pan scoop and handle arranged to lock the scoop at least at two positions relative to the handle, including a substantially perpendicular and a substantially parallel position.

It is another object of the invention to provide a locking hinged dust pan that durable, inexpensive, and easy to merchandise, display, transport, store and use.

It is another object of the invention to provide a pivoting and locking dust pan assembly as described, with mounting means to fix a conventional broom to the dust pan assembly to form an integral unit.

It is another object of the invention to dispose means for controlling locking of the dust pan at an easily accessible location that remains clear of interference with the dust pan scoop.

These and other objects of the invention are met by a dust pan construction with a selectively lockable hinged joint. The dust pan has a pan-shaped base member having three side walls and an open front scoop or blade portion over which debris is scooped or swept. Preferably the scoop is open at the top, and pivotally attached to the handle on an axis at the rear of the scoop. A bracket for the handle is integrally formed in or attached to the rear wall of the pan-shaped scoop, and forms a pivot joint and lock for the scoop and handle portion relative to one another.

The bracket preferably forms a U-shaped channel having a base and two spaced facing surfaces extending from the bracket base. The bracket defines an interior cavity receiving the end of the handle. The two spaced bracket surfaces can extend perpendicular to the rear wall of the pan-shaped scoop or base member, defining an unrestricted rear portion to allow pivoting of the handle in the bracket between a position substantially parallel to the plane of the scoop and a position substantially perpendicular to the scoop. The two spaced sidewalls have a bore carrying a pivot pin that extends through a transverse bore in the end of the handle, which is elongated for grasping by a standing user in the perpendicular position. At least one of the two spaced sidewalls includes at least two locking detents for fixing the handle in the two positions.

The detents preferably are formed by at least two bores spaced radially from the pivot axis by an equal distance, defining female locking means for receiving a movable locking pin associated with the handle. The handle has at least one transverse depressible member such as a spring loaded pin, at a corresponding distance from the pivot axis. The pin defines male locking means aligned with the bracket female locking means of the detent.

The locking positions of the pivoting handle relative to the dust pan defines at least two positions, a substantially perpendicular position for sweeping debris into the dust pan and a substantially parallel position for disposing of the gathered debris in a shovel-like manner and also for optimal storage and optimal display.

The dust pan arrangement may also include means on the handle and/or the hinged bracket to receive a broom in a compact arrangement wherein the broom and the dust pan arrangement are preferably attached. This is particularly advantageous for compact storage and display, with the broom head placed in the scoop, and the scoop arranged parallel to the handle. A clamp for the broom handle preferably is disposed on the dust pan handle at a distance from the scoop. The rear wall of the scoop may include a top indentation in which the clamped broom nests.

These and other advantages of the invention will become more apparent in connection with the following description of certain embodiments of the invention disclosed as non-limiting examples.

BRIEF DESCRIPTION OF THE DRAWINGS

There are shown in the drawings the embodiments of the invention as presently preferred. It should be understood that the invention is capable of embodiment in a member of specific arrangements in accordance with this disclosure, and reference should be made to the appended claims rather than the discussion of exemplary embodiments to assess the scope of the invention in which exclusive rights are claimed. In the drawings.

DETAILED DESCRIPTION OF THE PREFERRED EMBODIMENTS

Although certain specific terms describing shapes, directions and the like are used in the following description for the sake of clarity, these terms are intended to assist in the understanding of the particular structure of the invention selected for exemplary illustration, and are not intended to define or limit the scope of the invention.

Figure 1:
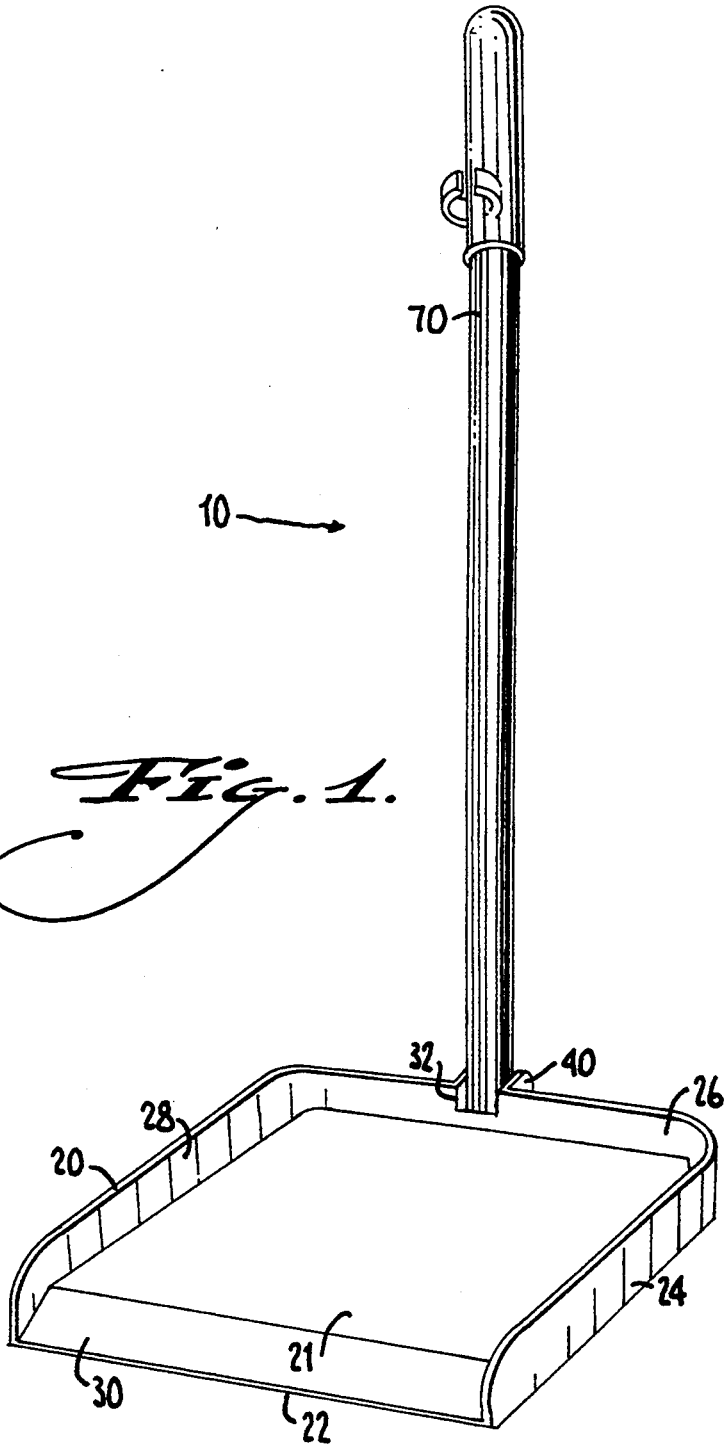
FIG. 1 is a perspective view of the locking hinged dust pan according to the invention.
Figure 2:
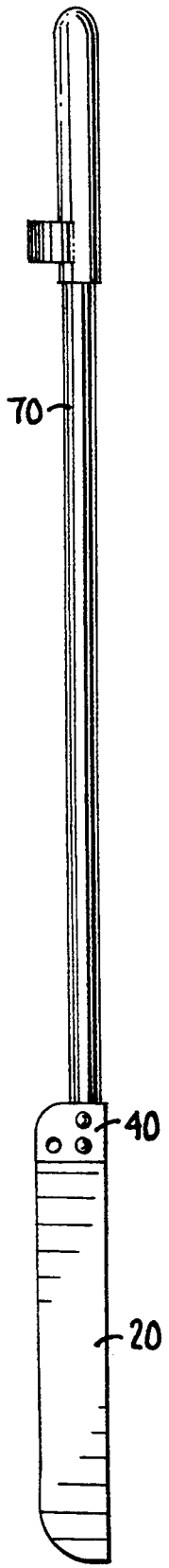
FIG. 2 is a side view of the locking hinged dust pan.

An exemplary embodiment of the dust pan construction 10 according to the invention is shown generally in FIGS. 1 and 2. The dust pan comprises a pan-shaped scoop or base member 20, a bracket 40, and a dust pan handle 70, whereby the dust pan base member and the handle are operatively connected. The dust pan is operated in known manner when configured as shown in FIG. 1, i.e., for use by a standing person holding the handle 70 in one hand and a broom (not shown in FIG. 1) in the other hand. The user urges debris over the edge or blade 22 of the scoop, collecting the debris on the bottom surface 21 until it is convenient to dump the debris. The dust pan is operated more like a shovel or push scoop when configured as shown in FIG. 2, which is convenient for loading a quantity of debris into a receptacle or the like. Additionally, in the configuration of FIG. 2, the dust pan arrangement is rendered compact for storage, transport or display.

The pan-shaped base member 20 has a generally planar body that extends laterally from the longitudinal axis of the handle 70 and has an open top. The base member 20 has an inner bottom surface 21 leading to an open front scoop or blade portion 22. Three shallow perpendicular walls 24, 26, 28, extend upwardly from and around three sides of the bottom surface 21, forming a walled enclosure for confining debris within the partially enclosed base member. The debris is confined so long as the scoop is not tilted forward, or tilted in another direction sufficient to allow the debris to pass over one of the walls.

The dust pan base member 20 has a lateral width of convenient size to collect debris therein, for example being slightly wider than the broom with which it is used. A preferred width is about one foot or 30 cm. The dust pan base member 20 has a length from front to rear of a suitable size to contain a substantial amount of gathered debris, e.g., about 8 inches or 20 cm. As noted hereinafter, the dust pan member is preferably large enough to encompass the head of a broom in a unitary storage arrangement. Accordingly, the length, width and depth of the base member in that case are made at least as large as the corresponding dimensions of the broom head. Preferably the length and width are a few centimeters larger than the broom head and the depth is about the same as the thickness of the broom head, e.g., 2–4 cm.

The open front scoop portion 22 is configured for easy flow of debris over the scoop portion and into the dust pan When placed on a horizontal surface, such as a floor. The open front scoop portion may be tapered at its terminal edge to define a ramp or incline 30 such that debris may be swept from a horizontal surface, such as a floor, into the pan-shaped base member 20 more efficiently.

The bottom surface 21 may also be tapered or inclined downward from the front to rear, defining a well such that retains the gathered debris accumulated in the pan-shaped base member 20 as the dust pan is carried around.

The dust pan-shaped base member 20 can be molded of plastic material such as polyethylene or polypropylene. The dust pan-shaped base member is preferably of lightweight construction, and alternatively can be made of sheet metal.

As shown generally in FIGS. 1 and 2, a bracket 40 is coupled to the pan-shaped base member 20 and is arranged to receive the bottom end of the dust pan handle 70. Bracket 40 is part of a pivotable coupling between the handle and the dust pan base member whereby the two can be moved between the perpendicular and collinear positions shown respectively in FIGS. 1 and 2, and locked in the chosen position. It is also possible to arrange for locking at additional angles. At least the two positions shown are preferred.

Figure 3:
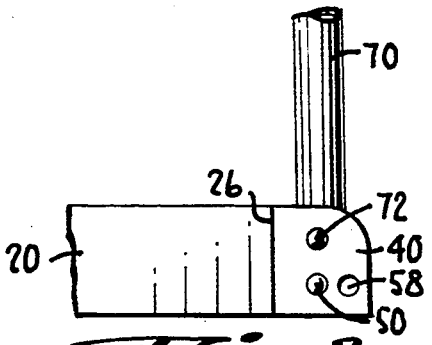
FIG. 3 is a side view of the locking hinged bracket in a substantially perpendicular locking position.
Figure 4:
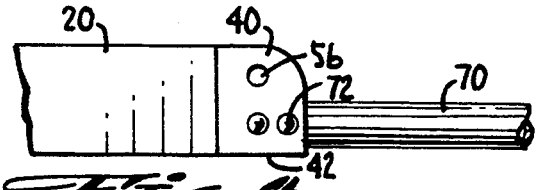
FIG. 4 is a side view of the locking hinged bracket in a substantially parallel locking position.
Figure 5:
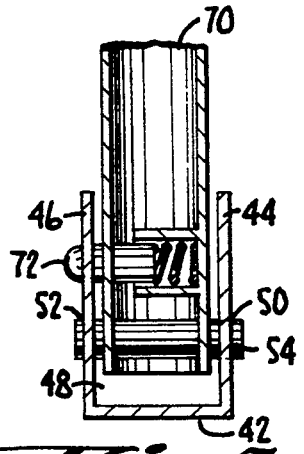
FIG. 5 is a front cross-sectional view of the locking hinged bracket.

Bracket 40 is shown in more detail in FIGS. 3–5. The bracket 40 preferably is formed integrally with the material of the dust pan scoop or base portion, but could comprise a U-shaped member that is attached to the base portion 20. Bracket 40 also may have laterally protruding ears (not shown) for attaching bracket 40 on the rear wall 26 and/or better supporting the joint with the handle. The bracket is rigidly fixed to base portion 20 and encompasses the end of handle 70 as shown in FIG. 5. A similar bracket can be formed in other particular ways, for example using two spaced angle brackets straddling the handle and attached at the rear of the base portion 20. In any event, base member 20 and handle 70 are pivotally coupled via the bracket 40 or the like, on a pivot axis transverse to the handle and parallel to the rear wall of the base portion 20. The bracket 40 comprises a generally planar base 42 and two spaced parallel surfaces 44, 46 extending upwardly from opposite sides of the base 42, thereby defining an interior space 48 along the distance of the two oppositely faced parallel surfaces. The interior space 48 defines a receptacle for receiving a standard dust pan handle 70 along the longitudinal axis at the bottom end of the handle.

The parallel surfaces 44, 46 have aligned bores 50, 52 along the pivot axis for handle 70. A shaft or pivot pin 54 is coupled between surfaces 44, 46 through a bore near the bottom end of the handle. Pin 54 may be a metal pin that is swaged or otherwise fixed so that it cannot escape axially from bores 50, 52. Alternatively, a plastic hinge pin can be fixed to the bracket by adhesive, heat welding, etc. Other specific pivot connections also may be used.

The bracket 40 is coupled to the rear wall 26 of the dust pan base member 20, with the parallel surfaces 44, 46 of the bracket extending perpendicularly rearward to encompass the handle 70. Preferably, the bracket 40 is integrally formed in the dust pan base member 20. The mounting arrangement restricts the pivot axis to a substantially 90° pivot range. The rear perpendicular wall 26 of the dust pan base member defines an abutment for the handle at 90° and the base 42 of the bracket defines an abutment for the handle at 0°. Thus, in the embodiment shown the handle 70 is limited to rotate only about 90° relative to the dust pan base 20, between the positions shown in FIGS. 1 and 2. Additionally, a detent arrangement is provided such that when rotated to the selected position the base member and handle remain locked.

The bracket 40 includes at least two locking means 56, 58 arranged for setting the joint to the selected angle. The locking means preferably fix the angle rigidly, but it is also possible to envision a resilient detent arrangement whereby the locking means can be overcome with sufficient force. In the embodiment shown in FIG. 4, the locking means interact with a lateral pin 72, that can be manually depressed for rotating the handle 70 relative to the base 20, or allowed to drop into one of the locking means 56, 58, whereupon the joint is rigidly locked.

Locking means 56 define a locked position in which the handle 70 is substantially perpendicular to the dust pan scoop or base member 20. In this position a user can operatively place the dust pan portion 20 along a horizontal surface such as a floor, while holding the elongated handle 70 with one hand in an upright stance. The user's free hand, for example, is used to sweep gathered debris with a broom into the dust pan assembly for collection.

Locking means 58 define the second locked position in which the handle 70 is substantially parallel to the dust pan shaped base member 20. This substantially parallel position permits a user to manipulate the dust pan in the manner of a shovel. For example the second position can be used to lift debris from a pile into a trash can, dumpster or other receptacle, or perhaps to use the device as a dust pan while bending over, or when cooperating with another person who operates a broom. The shovel arrangement is relatively more efficient than the perpendicular configuration for disposing of debris into a disposal receptacle, because it is much easier to prevent substantial loss of the debris from the dust pan, e.g., over the shallow sides.

The parallel locking position also permits compact storage of the dust pan assembly. In the parallel position the dust pan can be stored, for example, in a storage closet, occupying a much smaller horizontal area than when in the perpendicular position. The parallel position is similarly useful for a merchandiser to display dust pan assemblies in a compact manner for sale, for example by stacking them horizontally or vertically, or by hanging them on a display wall. This arrangement is compact because the dust pan portion 20 resides in the same plane as the handle 70.

Locking means can be provided on either or both of the parallel surfaces 44 or 46 of the bracket. The oppositely faced parallel surface 44 and/or 46 thus may include at least two locking bores 56, 58 at the same radial space from the pivot axis, defining female locking means for receiving a spring loaded locking pin 72, only one locking pin and one set of locking holes 56, 58 being shown in FIGS. 3, 4 and 5.

The elongated handle 70 can be about a meter in length. Handle 70 can be solid or hollow, and as shown in FIG. 5 is hollow. The handle is pivotally connected to the bracket by pin 50, and pivotally fixable by spring pin 72 that is carried in a supporting tube. Pin 72 is urged outwardly by a compression spring and has a shoulder that bears against the inside of the hollow handle to retain the pin in the handle at its maximum extension. Pin 72 defines a male locking means 72 at a distance from the pivot connection equal to that of female locking holes 56, 58 in the bracket.

Depressing spring-loaded pin 72 disengages the locking means, permitting relative rotation of the handle and base around pivot pin 50. When the pin 72 then aligns with one of holes 56 and 58, the pin protrudes and the arrangement locks. This form of locking means is simple and durable, although other conventional locking means may be used for a similar function.

Figure 6:
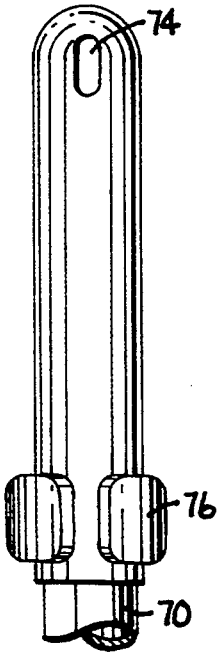
FIG. 6 is a perspective view of the elongated handle having clamping means.
Figure 7:
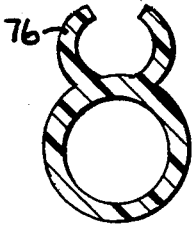
FIG. 7 is a perspective view of the clamping means.
Figure 8:
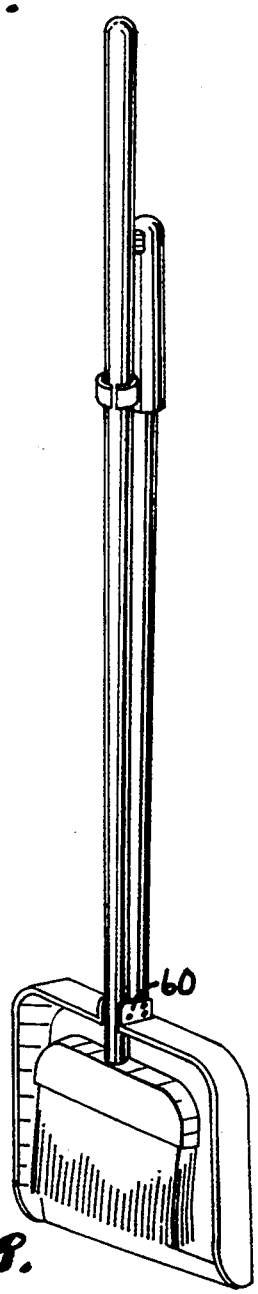
FIG. 8 is a perspective view of a locking hinged dust pan having a broom arrangement clamped thereto.

As shown in FIGS. 6–8, the handle 70 may include a hook or through hole 74 near its top end, for hanging the dust pan during storage or display. The elongated handle 70 may further include a clamping means 76 positioned on the front portion the handle 70 and arranged to removably attach a conventional broom handle to the front of the dust pan arrangement. The attached broom and dust pan form an integral cleanup kit or unit for storage and display. The two surfaces 44, 46 of the bracket 40 can be elongated at their top portions to define a second clamping means 60 for attachment near a lower end of a broom handle when the dust pan is positioned in the parallel position for storage or display as shown in FIG. 8. When in the perpendicular position, only the upper clamp is used to engage the broom handle.

The rear wall 26 of the dust-pan shaped base member 20 preferably has an indentation 32 in the top of the rear wall 26 at the coupling with bracket 40. This indentation provides a space where the handle of a broom held on the dust pan assembly can nest. The broom head thus can be placed in the pan-shaped base member 20 instead of resting against the top edge of the rear wall 26, making the arrangement even more compact. The lateral width of the dust pan-shaped member 20, the length from lip 22 to wall 26, and the height of the sidewalls, are all of suitable size to accommodate the broom head of the clamped broom assembly in the volume encompassed by the pan-shaped base member 20.

The upper clamp 76 can be formed integrally with a grip that fits over the end of handle 70 as shown in FIG. 6. The grip also can be the site of the hanging hole 74. Alternatively, the attachment structures for affixing the broom handle to the dust pan assembly can be disposed on the broom handle rather than on the dust pan, with similar results.

Figure 9:
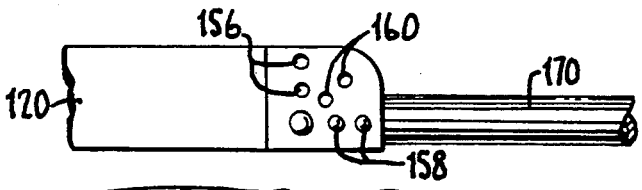
FIG. 9 is a side view of an alternative embodiment of the locking hinged bracket in a substantially parallel locking position.
Figure 10:
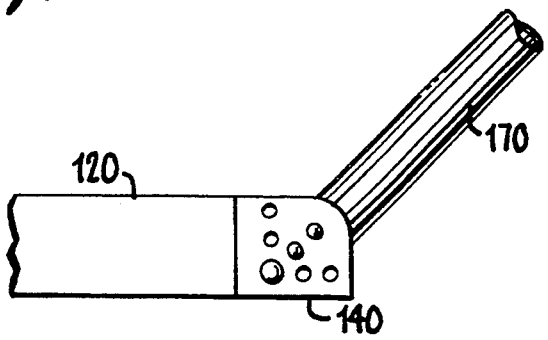
FIG. 10 is a side view of the alternative embodiment of the locking hinged bracket in a locking position between substantially parallel and substantially perpendicular.
Figure 11:
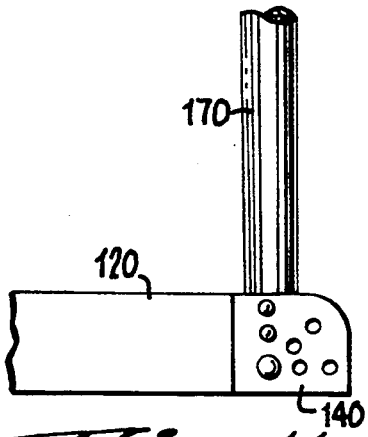
FIG. 11 is a side view of the alternative embodiment of the locking hinged bracket in a substantially perpendicular locking position.

An alternative embodiment is shown generally in FIGS. 9, 10 and 11 where a bracket 140 is coupled to a pan-shaped base member 120 and is arranged to receive the bottom end of a dust pan handle 170. Bracket 140 is part of a pivotable coupling between the handle and the dust pan base member whereby the two can be moved between perpendicular and collinear positions and locked in any chosen position.

In this embodiment as shown in FIGS. 9, 10 and I 1, the bracket 140 can include at least three locking means 156, 158 and 160 which interact with two spaced lateral pins, 172, 174 wherein depressible pin 172 can be manually depressed to release additional locking pin 174 for rotating the handle 170 relative to the base 120, or allowed to drop into one of the locking means 156, 158, 160, whereupon the joint is rigidly locked. Each of the locking means can include at least two linearly spaced locking bores for each locking position which are radially spaced apart from each other along the pivot axis.

Figure 12:
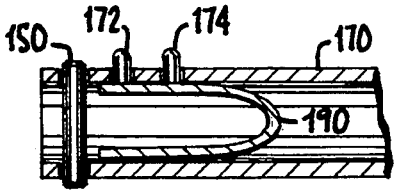
FIG. 12 is a cross-sectional view of an alternative embodiment of the locking hinged handle, with the mechanism in a locking position.
Figure 13:
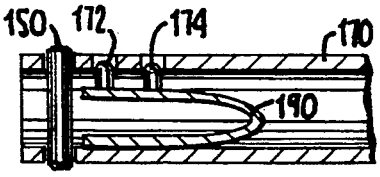
FIG. 13 a cross-sectional view of the alternative embodiment of FIG. 12, with the mechanism in a release position.

In this embodiment as shown in FIGS. 12 and 13, the elongated handle 170 can be pivotally connected to the bracket 140 by pivot pin 150, and pivotally fixable by resiliently biasing pins 172, 174 that are mounted in the handle tube on a flexible member 190. The flexible member 190 laterally biases the pins 172, 174 to protrude through two bores in the handle tube wall to thereby engage the locking means on the bracket 140. In addition, a plurality of locking means (not shown) can be provided to pivotally fix a handle relative to the dust pan base at any position along the pivot axis.

Figure 14:
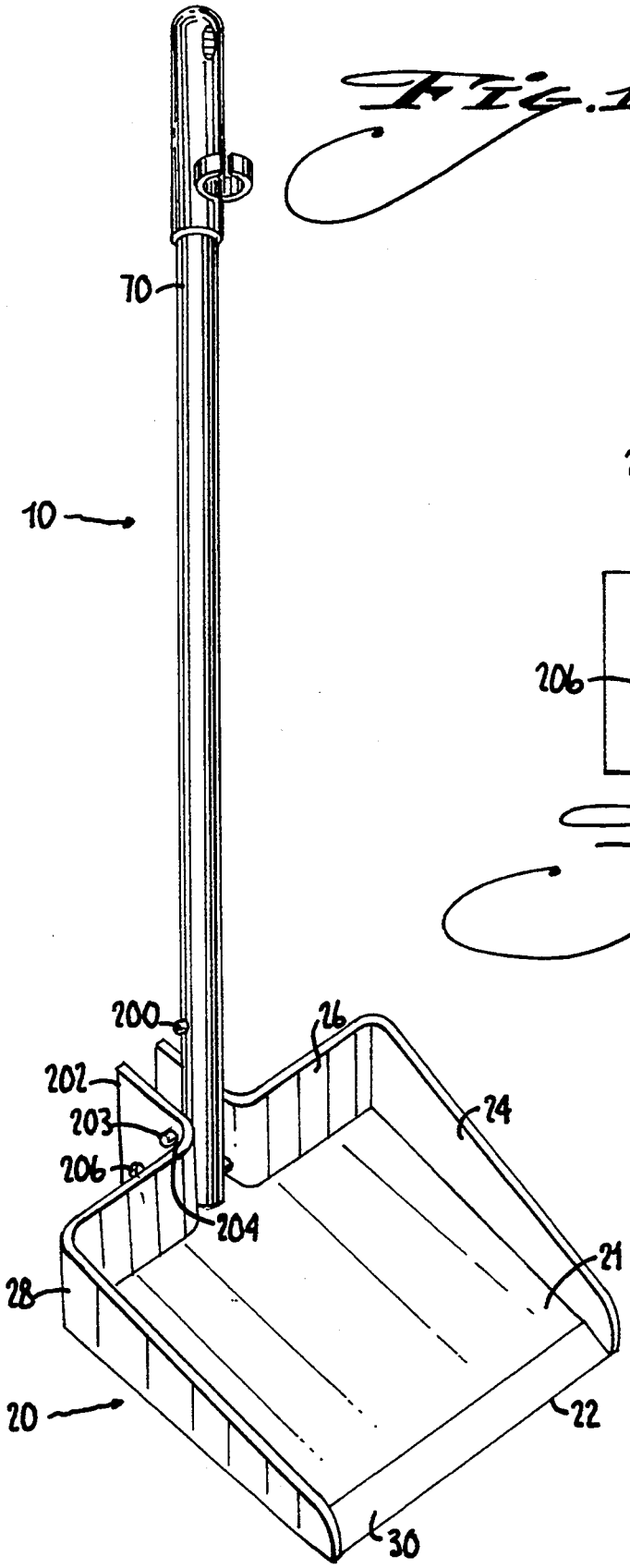
FIG. 14 is a perspective view of a further alternative embodiment comprising a lock control button disposed up the handle clear of the pan.
Figure 14A:
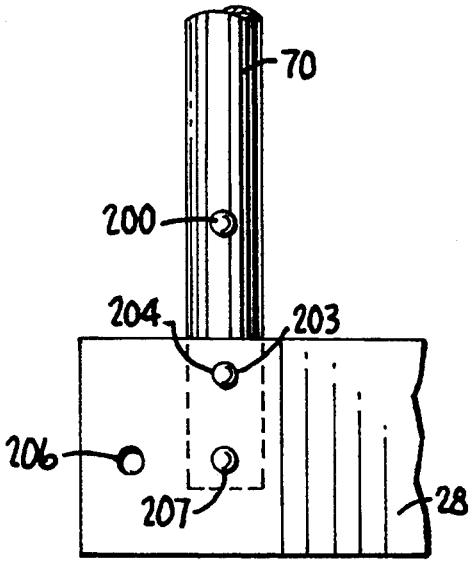
FIG. 14*a* is a cut-away side view showing the handle-pan joint of the dust pan of FIG. 14.
Figure 15:
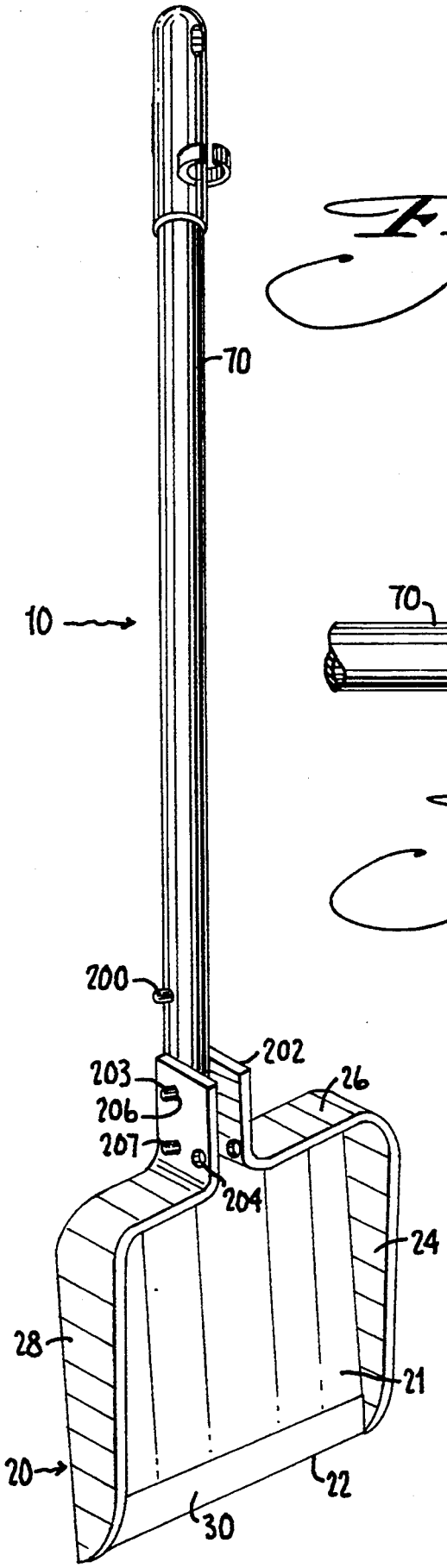
FIG. 15 is a perspective view of the locking hinged dust pan with the pan and handle substantially parallel.
Figure 15A:
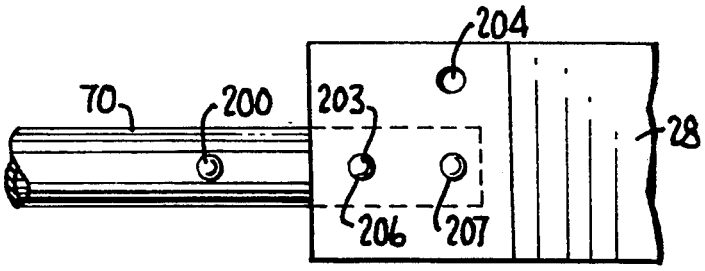
FIG. 15*a* is a side cut-away view of the handle-pan joint of the dust pan as shown in FIG. 15.

A preferred embodiment is shown in FIGS. 14 and 14*a*. FIG. 14 shows general dust pan construction 10 having a handle 70 pivotally connected to dust pan shaped scoop or base member 20. As in previous embodiments, dust pan shaped scoop or base member 20 has walls 24 and 28, rear wall 26 and edge or blade 22. However, a locking pin actuator 200 is arranged at a space along handle 70 and positioned outside from the handle receiving collar 202, and therefore remains accessible and free from interference with the collar 202. Locking pin actuator 200 is manually depressed to control retraction of locking pin 203, enabling handle 70 and scoop 20 to pivot between locking position 204 and 206. Locking positions 204 and 206 are generally defined by apertures in a side wall of handle receiving collar 202. The handle pivots about axle 207. FIGS. 14 and 14*a* depict the dust pan construction with the handle 70 substantially perpendicular to pan shaped scoop or base member 20. FIGS. 15 and 15*a* depict the dust pan construction 10 with handle 70 substantially parallel to or in the same plane as pan shaped scoop or base member 20.

Figure 16:
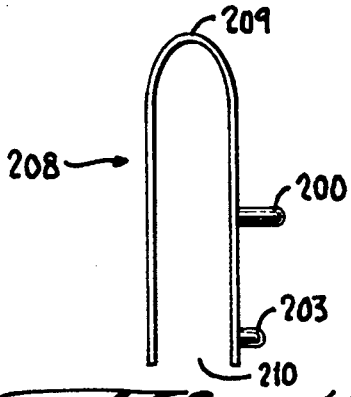
FIG. 16 is an elevation; view showing a V-shaped spring for the locking mechanism according to the invention.
Figure 17A:
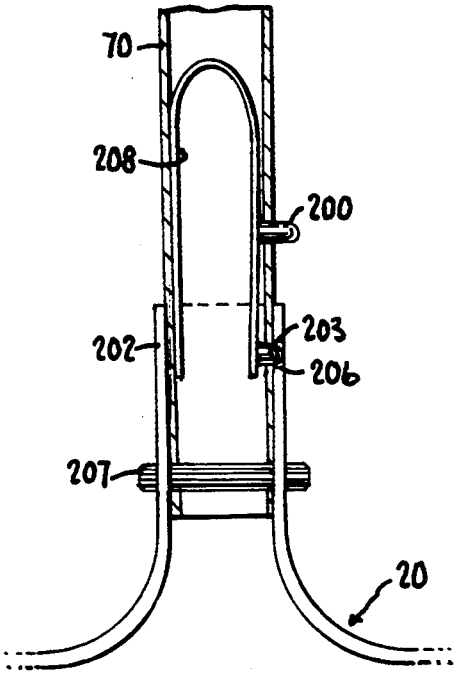
FIG. 17*a* is a partial section view showing the spring of FIG. 16 disposed in a dust pan handle with the locking pin in a retracted position, and including a separate axle for handle pivoting.
Figure 17B:
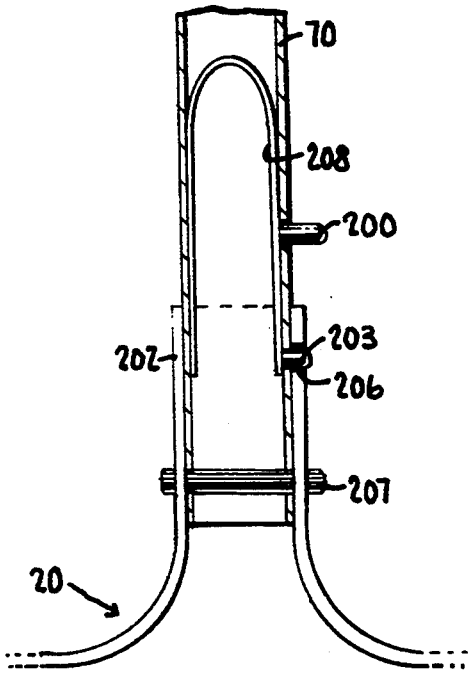
FIG. 17*b* is a partial section cut-away view showing the spring of FIGS. 16 and 17*a*, with the locking pin in a locking position.
Figure 20:
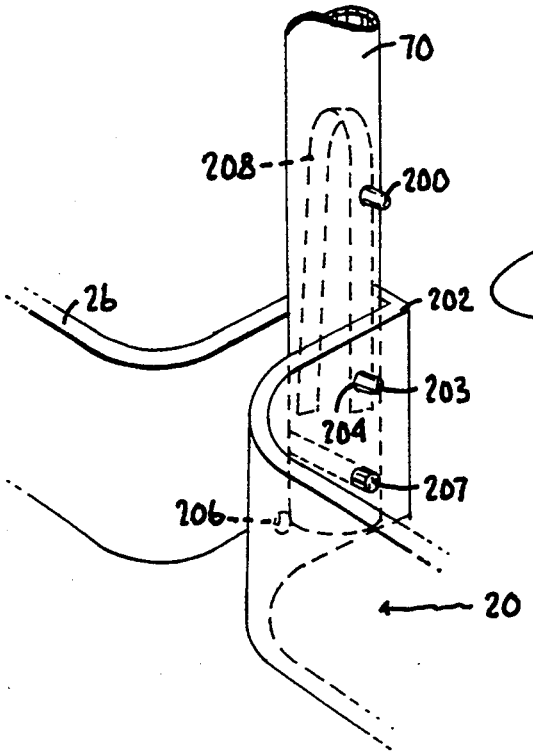
FIG. 20 is a partial perspective view showing the V-shaped spring of FIG. 16 disposed in the handle.

A spring for a locking mechanism that is simple and effective, and locates locking pin actuator 200 outside a region of interference with handle receiving collar 202, is shown in FIG. 16. FIG. 16 depicts; V-shaped spring 208 having closed end 209 and open end 210. Locking pin 203 is attached to or integral with spring 208, and projects adjacent the open end 210 of spring 208. Locking pin actuator button 200 preferably forms a similar but longer projection nearer: to the closed end 209, for reasons explained below. FIGS. 17*a*, 17*b* and 20 illustrate the V-shaped spring 208 disposed within a hollow bottom end of handle 70, in different operative positions. FIGS. 17*a* and 17*b* depict handle 70 in a same parallel plane as pan shaped scoop 20. FIG. 20 depicts handle 70 perpendicular to pan shaped scoop 20.

As shown in FIG. 17*b*, V-shaped spring 208 is compressed and placed in the hollow bottom portion of handle 70 and biases locking pin 203 and actuator button 200 outwardly relative to the wall of handle 70. Locking pin actuator 200, which is attached to or a part of V-shaped spring 208, protrudes through an aperture in handle 70. Locking pin 203 presses outwardly through an aperture in handle 70 and through an aperture defining locking position 206. Axle 207 defines the pivot axis for relative rotation of handle 70 and pan shaped scoop 20.

The shovel-like configuration of dust pan construction 10 as shown in FIG. 17*b* is useful for loading a quantity of debris into a receptacle or the like as discussed above. In order to modify the configuration of dust pan construction 10 for use in a known manner i.e., for use by a standing person holding the handle 70 in one hand and a broom (not shown) in another hand, it is necessary to disengage locking pin 203 from locking position 206. This is accomplished by exerting pressure on locking pin actuator 200, such as by manually depressing locking pin actuator 200 with a thumb or finger. Pressure on locking pin actuator 200 compresses V-shaped spring 208 causing locking pin 203 to retract out of locking position 206. Locking pin actuator 200 is longer than locking pin 203 to facilitate complete disengagement of locking pin 203 when actuator 200 is depressed but a portion of actuator 200 remains outside the wall of handle 70, i.e., as shown in FIG. 17*a*. This aspect of actuator 200 also positively positions the V-shaped spring so that locking pin 203 is in the correct position to engage the locking apertures. Retraction of locking pin 203 out of locking position 206 enables pivoting of handle 70 about axle 207, e.g. to the position illustrated in FIG. 20.

As shown in FIG. 20 handle 70 is in a position perpendicular to dust pan construction 10. When the handle and scoop are rotated into a locking position, locking pin 203 snaps into place in the corresponding aperture due to the outward bias of V-shaped spring 208.

Figure 18:
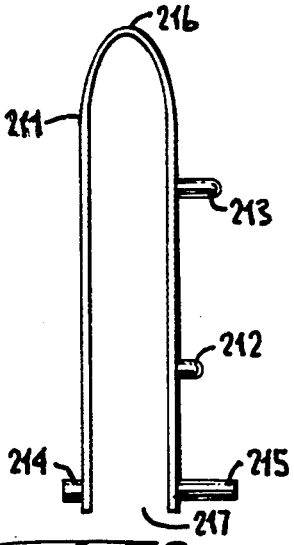
FIG. 18 is an elevation view showing an alternative V-shaped spring including attached pivot pin means.

An alternative embodiment using a V-shaped spring mechanism with a locking pin actuator disposed clear of potential interference with a handle receiving collar is illustrated in FIGS. 18, 19*a*, 19*b* and 20*a*. An alternative V-shaped spring 211 for this purpose is depicted in FIG. 18. As in other embodiments of the V-shaped spring, V-shaped spring 211 has a locking pin 212 and a locking pin actuator 213, preferably attached to or integral with the spring. V-shaped spring 211 has a closed end 216 and an open end 217. Each leg of V-shaped spring 211 has a respective axle projection 214 and 215 near an end adjacent to open end 217.

Figure 19A:
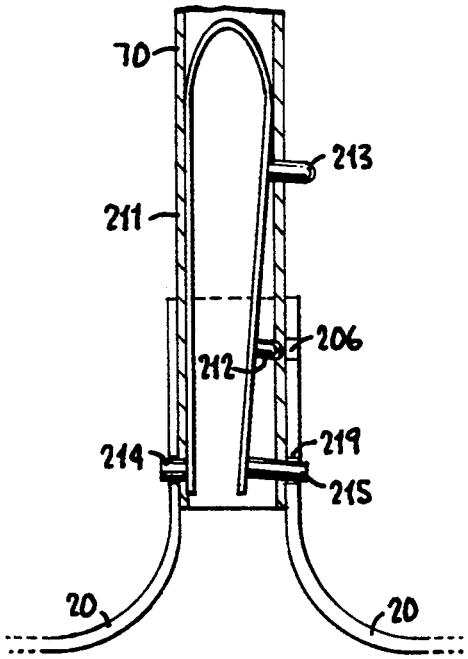
FIG. 19*a* is a partial section view showing the spring of FIG. 18 in a dust pan handle wherein the locking pin is retracted.
Figure 19B:
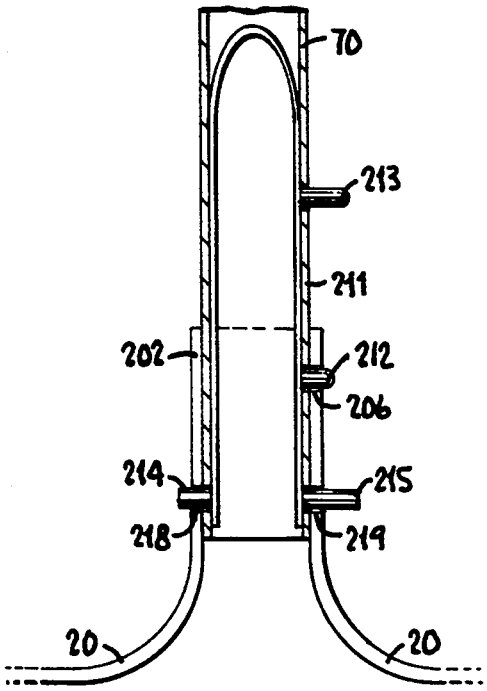
FIG. 19*b* is a partial section view of the spring of FIG. 18 in a dust pan handle wherein the locking pin is in its locking position.

V-shaped spring 211 operates substantially as discussed above with reference to FIGS. 16, 17*a*, 17*b*, and 20*a*. However, axle projections 214 and 215 provide the pivot axle, instead of a separate axle 207. Thus the device is very easily assembled. FIG. 19*b* shows the handle 70 locked in a position parallel to pan shaped scoop 20. V-shaped spring 211 is compressed between the opposite inside walls of the handle, and exerts outward force on the respective locking, actuating and axle projections from inside handle 70. Locking pin actuator 213 projects through the wall of handle 70 through a locking pin actuator aperture in handle 70. Locking pin 212 likewise is biased to extend through an aperture at a selected locking position to lock handle 70 in position. Axle projections 214 and 215 are biased to extend through axle apertures 218 and 219 in handle receiving collar 202, to allow pivoting of handle 70 with respect to pan shaped scoop 20.

To reposition handle 70, e.g., to a position perpendicular to the plane of scoop 20, an operator depresses locking pin actuator 213 to retract locking pin 212 from locking position 206. Axle projection 215, on the leg of spring 211 that is thereby moved, is longer then locking pin 212. As shown in FIG. 19*a*, axle projection 215 thus remains seated in axle aperture 219 even when locking pin actuator 213 is depressed to compress V-shaped spring 211 and to retract locking pin 212 from locking position 206. Thus, actuator pin 213 and pivot pin 215 remain engaged with the handle, even more positively maintaining locking pin 212 in position to engage a locking aperture.

Figure 20A:
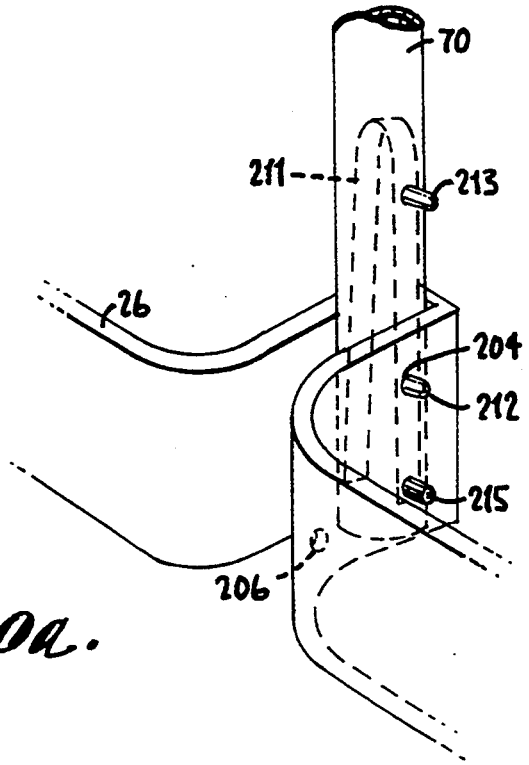
FIG. 20*a* is a partial perspective view showing the V-shaped spring of FIG. 18 disposed in the handle.

Retraction of locking pin 212 from a locking aperture, e.g., at locking position 206, allows pivoting of handle 70 with respect to pan shaped scoop 20 about axle projections 214 and 215. Handle 70 can be locked in the other locking position(s), for example as shown in FIG. 20*a*, wherein locking pin 212 protrudes through locking position 204. The dust pan is then positioned for use by a standing person in a conventional manner.

Figure 21:
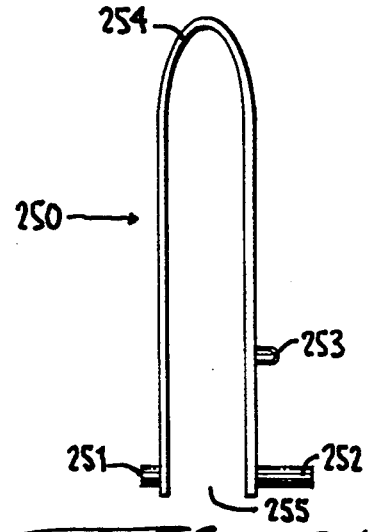
FIG. 21 is a side view of yet another type of V-shaped spring used in the invention.
Figure 22A:
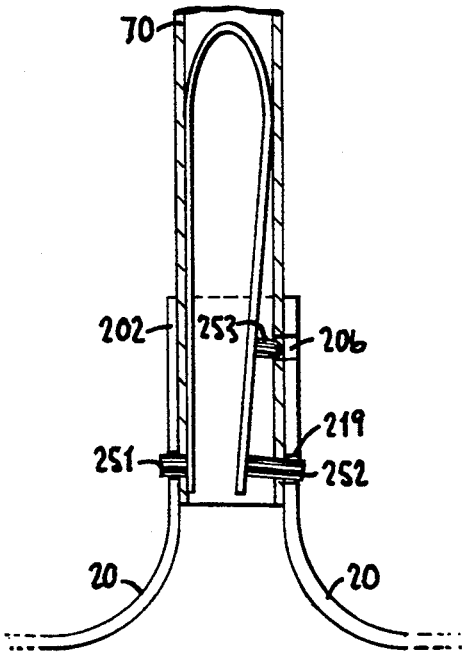
FIG. 22*a* is a side cut-away view of the spring of FIG. 21 disposed in a dust pan handle wherein the locking pin is in a retracted position.
Figure 22B:
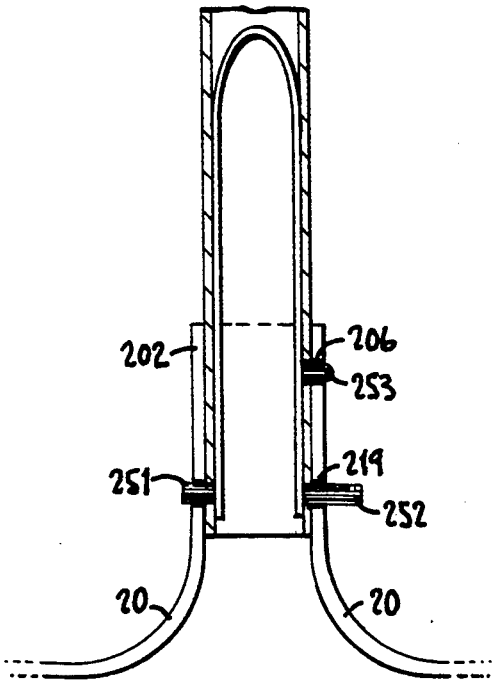
FIG. 22*b* is a side cut-away view of the spring of FIG. 21 disposed in a dust pan handle wherein the locking pin is in a locking position.

Another embodiment is shown in FIGS. 21, 22*a* and 22*b*. The V-shaped spring is similar to that shown in FIGS. 18, 19*a* and 19*b* except that there is no separate locking pin actuator.

As shown in FIGS. 21, 22*a* and 22*b*, V-shaped spring 250 has closed end 254 and open end 255. V-shaped spring 250 has axle projections 251 and 252. Locking pin 253 protrudes laterally from one side of V-shaped spring 250.

Operation of V-shaped spring 250 is identical to operation of the V-shaped spring discussed above with respect to FIGS. 18, 19*a* and 19*b*, however axle projection 252, projecting through axle aperture 219 doubles as a locking pin actuator. For example, as shown in FIG. 22*a*, pressure exerted on axle projection 252 deflects V-shaped spring 250 inwardly, therby retracting locking pin 253 from locking position 206. Handle 70 is thus free to pivot with respect to pan shaped scoop 20, as discussed above.

The invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to asses the scope of the invention in which exclusive rights are claimed.

We claim:

1. A dust pan assembly, comprising:

a base member generally defining a pan with an open front, the base member having a bottom, an open front scoop portion and three walls extending upwardly around the bottom, one of said three walls being a rear wall remote from the open front scoop portion, the other two of said three walls terminating at said open front scoop portion;

a pair of spaced opposed surfaces defining a handle receiving collar having a handle receiving region at said rear wall, and having at least two locking receptacles defining locking positions disposed on one of said spaced opposed surfaces;

an elongated handle having a hollow bottom received by said collar within the handle receiving region of said collar;

pivot means for pivotally coupling said handle to said base member, said pivot means defining a pivot axis;

an essentially V-shaped spring disposed in said bottom of said handle having two legs compressed towards one another by walls of the handle, the legs defining an open end and a closed end, the spring bearing at least two projections being urged laterally outwardly from the handle by the spring along one of said legs, the projections being spaced longitudinally of the handle, wherein one of the projections, nearer the pivot axis, protrudes from a first opening in said handle to define a locking pin movable outwardly of the handle to engage a respective one of the locking receptacles, and another of the projections more remote from the pivot axis and at a point outside of said handle receiving region, defines a locking means actuator coupled to said locking pin, whereby depression of the locking means actuator causes retraction of the locking pin from a respective one of said locking receptacles enabling pivoting of said handle between the locking positions and wherein said handle is selectively lockable in at least two locking positions, by rotation of said handle around the pivot axis to align said locking pin with a respective one of said locking receptacles.

2. The dust pan assembly of claim 1, wherein the spring is disposed in the handle in an inverted manner with the closed end up, the locking pin being disposed nearer to the open end and the locking pin actuator being disposed nearer to the closed end of the spring.

3. A dust pan assembly, comprising:

a base member generally defining a pan with an open front, the base member having a bottom, an open front scoop portion and three walls extending upwardly around the bottom, one of said three walls being a rear wall remote from the open front scoop portion, the other two of said three walls terminating at said open front scoop portion;

a pair of spaced opposed surfaces defining a handle receiving collar having a handle receiving region at said rear wall, and having at least two locking receptacles defining locking positions disposed on one of said spaced opposed surfaces and opposing axle apertures disposed in each of said spaced opposed surfaces;

an elongated handle having a hollow bottom end received by said collar within said handle receiving region of said collar;

a substantially cylindrical axle disposed laterally through said bottom end and protruding outwardly through opposite side walls of said handle through said opposing axle apertures thereby allowing pivoting of said elongated handle with respect to said base member between said locking positions defined by said locking receptacles;

a compressible V-shaped spring defined by a pair of joined legs and having an open end and a closed end disposed in said hollow bottom end of said elongated handle, said V-shaped spring having at least two projections spaced apart longitudinally along the handle on a same leg of said V-shaped spring, wherein one of the projections, nearer the open end, defines a retractable locking pin protruding through a locking pin aperture in said bottom end of said handle and is engageable with a respective one of said locking receptacles to fix said elongated handle in place relative to the base member, and wherein one of the projections, nearer the closed end, defines a locking pin actuator protruding from an actuator aperture in said handle at a point outside of said handle receiving region, and wherein the projections and the spring are mechanically coupled such that pressure exerted on said locking pin actuator retracts said locking pin from engagement with one of said locking receptacles, thereby allowing said handle to pivot with respect to said base member.

4. A dust pan assembly, comprising:

a base member generally defining a pan with an open front, the base member having a bottom, an open front scoop portion and three walls extending upwardly around the bottom, one of said three walls being a rear wall remote from the open front scoop portion, the other two of said three walls terminating at said open front scoop portion;

a pair of spaced opposed surfaces defining a handle receiving collar having a handle receiving region at said rear wall, and having at least two locking receptacles defining locking positions disposed on one of said spaced opposed surfaces and opposing axle apertures disposed in each of said spaced opposed surfaces;

an elongated handle having a hollow bottom end received by said collar within said handle receiving region of said collar;

a compressible V-shaped spring defined by a pair of joined legs and having an open end and a closed end disposed in said hollow bottom end of said elongated handle, said V-shaped spring having first, second and third projections spaced apart on a same leg of said V-shaped spring, said first projection disposed adjacent the open end of said V-shaped spring, said third projection disposed adjacent the closed end of said V-shaped spring and said second projection disposed between said first and third projections, and a fourth projection disposed on the other of said legs of said V-shaped spring coaxially opposite said first projection, wherein said first and fourth projections protrude through said opposing axle apertures in said spaced opposed surfaces of said handle receiving collar thereby allowing pivoting of said elongated handle with respect to said base member between the locking positions defined by said locking receptacles, said second projection defining a retractable locking pin protruding through a locking pin aperture in said bottom end of said elongated handle engageable with one of said locking receptacles to fix said elongated handle in place, and wherein said third projection defines a locking pin actuator protruding through an actuator aperture in said handle at a point outside of said handle receiving region, the projections and the V-shaped spring being mechanically coupled such that pressure exerted on said locking pin actuator retracts said locking pin from engagement with one of said locking receptacles, thereby allowing free pivoting of said handle with respect to said base member.

5. A dust pan assembly, comprising:

a base member generally defining a pan with an open front, the base member having a bottom, an open front scoop portion and three walls extending upwardly around the bottom, one of said three walls being a rear wall remote from the open front scoop portion, the other two of said three walls terminating at said open front scoop portion;

a pair of spaced opposed surfaces defining a handle receiving collar having a handle receiving region at said rear wall, and having at least two locking receptacles defining locking positions disposed on one of said spaced opposed surfaces and opposing axle apertures disposed in each of said spaced opposed surfaces;

an elongated handle having a hollow bottom end received by said collar within said handle receiving region of said collar;

a compressible V-shaped spring defined by a pair of joined legs and having an open end and a closed end disposed in said hollow bottom end of said elongated handle, said V-shaped spring having first and second projections spaced apart on a same leg of said V-shaped spring, said first projection disposed adjacent the open end of said V-shaped spring, said second projection disposed apart from said first projection, and a third projection disposed on the other of said legs of said V-shaped spring coaxially opposite said first projection, wherein said first and third projections protrude through said opposing axle apertures in said spaced opposed surfaces of said handle receiving collars to define pivot means thereby allowing pivoting of said elongated handle with respect to said base member between the locking positions defined by said locking receptacles, said second projection defining a retractable locking pin protruding through a locking pin aperture in said bottom end of said elongated handle engageable with one of said locking receptacles to fix said elongated handle in place, and wherein said first projection further defines a depressible locking pin actuator, the locking pin and the V-shaped spring being mechanically coupled such that pressure exerted on said first projection retracts said locking pin from engagement with one of said locking receptacles, thereby allowing free pivoting of said handle with respect to said base member.

6. The dust pan assembly of claim 5, wherein at least three projections are provided on said one of the legs, spaced longitudinally along the handle, respectively defining a part of the pivot means, the locking pin and the locking pin actuator, and wherein the at least three projections vary in length such that depression of the locking pin actuator only disengages the locking pin from a respective one of the locking receptacles.

7. The dust pan assembly of claim 6, wherein the at least three projections include at least one projection adjacent the bottom of the handle defining at least part of the pivot means and at least one projection spaced upwardly from the bottom of the handle and clear of said handle receiving region defining the locking pin actuator, which are longer than an intermediate projection, defining the locking pin.

8. The dust pan assembly of claim 7, wherein the spring is inverted in the handle with said closed end up, the projections for the pivot means being disposed adjacent the open end of the V-shaped spring at the bottom of the handle.

* * * * *